United States Patent [19]

Schott

[11] Patent Number: 4,712,056

[45] Date of Patent: Dec. 8, 1987

[54] SIGNALLING CIRCUIT

[75] Inventor: Heinrich Schott, Munich, Fed. Rep. of Germany

[73] Assignee: Siemens Aktiengesellschaft, Berlin and Munich, Fed. Rep. of Germany

[21] Appl. No.: 809,188

[22] Filed: Dec. 16, 1985

[30] Foreign Application Priority Data

Dec. 20, 1984 [DE] Fed. Rep. of Germany ..... 3446628

[51] Int. Cl.[4] ..... G05F 3/16

[52] U.S. Cl. ..... 323/315; 340/652

[58] Field of Search ..... 361/86, 88, 92; 307/350, 362; 340/652, 653, 660; 323/315, 316, 313

[56] References Cited

U.S. PATENT DOCUMENTS

| | | | |
|---|---|---|---|
| 3,761,775 | 9/1973 | Ozawa et al. | 340/653 X |
| 3,903,430 | 9/1975 | Arns | 340/652 X |
| 4,514,648 | 4/1985 | Dotson et al. | 307/350 |
| 4,560,921 | 12/1985 | Yamatake | 307/362 X |
| 4,567,539 | 1/1986 | Sinberg | 361/92 |
| 4,594,518 | 6/1986 | Pollachek | 307/350 |

OTHER PUBLICATIONS

Siemens Review, vol. XLI (1974), Special Issue, "Communications Engineering", pp. 334 and 335.

*Primary Examiner*—A. D. Pellinen
*Assistant Examiner*—Derek S. Jennings
*Attorney, Agent, or Firm*—Hill, Van Santen, Steadman & Simpson

[57] ABSTRACT

A signalling circuit which outputs reference potential at either a first or second output, dependent on an input signal. The signalling circuit operates reliably in a large range of operating voltage with an optimally low power consumption. A constant current circuit and a parallel connection of two current paths fed by constant current are provided in a circuit connected to an operating voltage source. The first and second outputs are respectively connected to reference potential via respective electronic switches controllable by the current of the respective current path. The constant current is switchable from one current path to the other and vice versa, dependent upon the input criteria.

12 Claims, 2 Drawing Figures

SIGNALLING CIRCUIT

BACKGROUND OF THE INVENTION

It is usual to monitor communications transmission technology facilities in view of their operating condition and signal service disruptions. Such devices for disruption signalling are known, for example, from the Siemens Zeitschrift 48 (1979), supplement "Nachrichten-Ubertragungstechnik", pp. 334 and 335. For example, the outage of supply voltages which serve for supplying communications technology apparatus is thereby indicated.

For example, for communications transmission technology power supply devices, the normal condition and the malfunction condition can be signalled since, as a normal status signal, a grounded potential is connected through in opposition to a feed voltage. Also, in the malfunction case, this signal is disconnected and a grounded potential is supplied instead in opposition to the same feed voltage as the malfunction status signal. The malfunction status signals can thus be preferably displayed with the assistance of a display element. The operating voltage for the signalling circuit itself is preferably independent of the feed voltage of the signal evaluation.

When monitoring circuits having an open collector output are employed for the devices to be monitored, then an OR operation can be achieved in a simple manner by connecting the outputs for the error messages in parallel. A signalling circuit is then required for controlling the signalling device, this signalling circuit supplying grounded potential at the corresponding output dependent on the output signals of the monitoring circuits. A malfunction status can then be optically displayed under given conditions.

The signalling circuit can be dimensioned for a specific operating voltage and can be adapted to the operating voltage respectively available. It is adapted with dropping resistors of various sizes in rough steps via internal bridges or by modifying the rack wiring. This involves additional expense, however. When a voltage regulator is provided for the operating voltage, then an undesirably high dissipated power already results in the normal status.

SUMMARY OF THE INVENTION

It is an object of the invention to fashion a signalling circuit such that it functions reliably in a broad range of operating voltages with the lowest possible power consumption.

In accordance with the invention, the signalling circuit for achieving this object is fashioned such that a switching path of a first electronic switch is situated between the first output and reference potential, and a switching path of a second electronic switch is situated between the second output and reference potential. The signalling circuit contains a constant current circuit connected to an operating voltage source. This constant current circuit comprises a parallel circuit of a first current path and a second current path connected thereto. The first electronic switch canbe switched conductive by the current flowing in the first current path, and the second electronic switch can be switched condctive by the current flowing in the second current path. Both lurrent paths are controllable dependent on the input criteria such that the first current path is conductive and the second current path is inhibited given the first input criterion, and the second current path is conductive and the first current path is inhibited given the second input criterion.

When these techniques are applied, the signalling circuit emits a reference potential at the first output in the one switch condition, and emits a reference potential at the other output in the other switch condition. The allocated electronic switch is open or in a high-resistance condition at the output respectively not connected to reference potential.

The techniques of the invention yield the advantage that the signalling circuit, given low dissipated power, can be fed from operating voltage sources having greatly differing nominal values of the voltage, and can therefore be employed in a particularly universal fashion. Since circuit parts which are arranged in parallel and function simultaneously have been largely avoided, a particularly low dissipated power thus results.

In a development of the invention, the signalling circuit is fashioned such that a first input criterion is a prescribed control potential, and a second control criterion is an open input circuit, and that the first current path contains the controlled segment of a transistor which has a control electrode connected to an input for the control criteria. The two current paths respectively contain a non-linear bipolar device such as a Zener-diode which is conductive above a prescribed voltage threshold, and is inhibited below the prescribed voltage threshold. The voltage threshold of the first non-linear bipolar device lying in the first current path is lower than the voltage threshold of the second non-linear bipolar device lying in the second current branch.

The transistor, for example, can be a bipolar transistor or a field effect transistor, whereby the emitter-collector path or the source-drain path of the transistor lies in the first current path. An arrangement comprising at least one diode and/or at least one Zener-diode can serve, in particular, as the non-linear bipolar device such as a Zener diode. In at least one of the electronic switches, the control path preferably lies in one of the two parallel current paths, particularly together with a resistor situated parallel to the control path.

Furthermore, it can also prove expedient in at least one of the electronic switches to connect the control path to the allocated current path via at least one transistor stage.

The constant current source can, for example, be a constant current diode or a stabilizing circuit wherein the voltage drop appearing at a current measuring resistor is compared to the Zener voltage of a Zener diode. In a further development of the invention, the signalling circuit is fashioned such that the constant current circuit is formed by a current stabilizing circuit situated in series with the parallel connection of the first and second current path and connected to the operating voltage source together with the parallel circuit. This current stabilizing circuit contains the control path of a first transistor and a resistor situated in series thereto. The control path of a second transistor lies parallel to the resistor. The collector of this second transistor is directly connected to the control terminal of the first transistor, and is connected to an operating voltage source via a resistor. Specifically, the first transistor is a field effect transistor and the second transistor is a bipolar transistor.

These techniques produce the advantage that the signalling circuit also functions reliably given relatively low operating voltages. In particular, reduced power dissipation results to a particular degree.

In case the signalling circuit is intended to indicate fault status criteria, it is preferably fashioned such that the signalling circuit contains a further constant current circuit connected to the second current path, this further constant current circuit being activatable by a current flowing in the second current path. A series connection of the second constant current circuit and a display element is connected to the operating voltage source. Switch means which are already present in the signalling circuit can be additionally exploited in an advantageous way such that the second constant current circuit contains a transistor as a controlled resistor which simultaneously is associated with a control stage for the second electronic switch and contains the nonlinear bipolar device situated in the second current path as its secondary standard.

It is particularly advantageous to employ the signalling circuit in combination with a plurality of monitoring devices having an open collector output such that the open collector outputs are wired in multiple fashion to the input of the signalling circuit.

DESCRIPTION OF THE PREFERRED EMBODIMENTS

Figure 1:
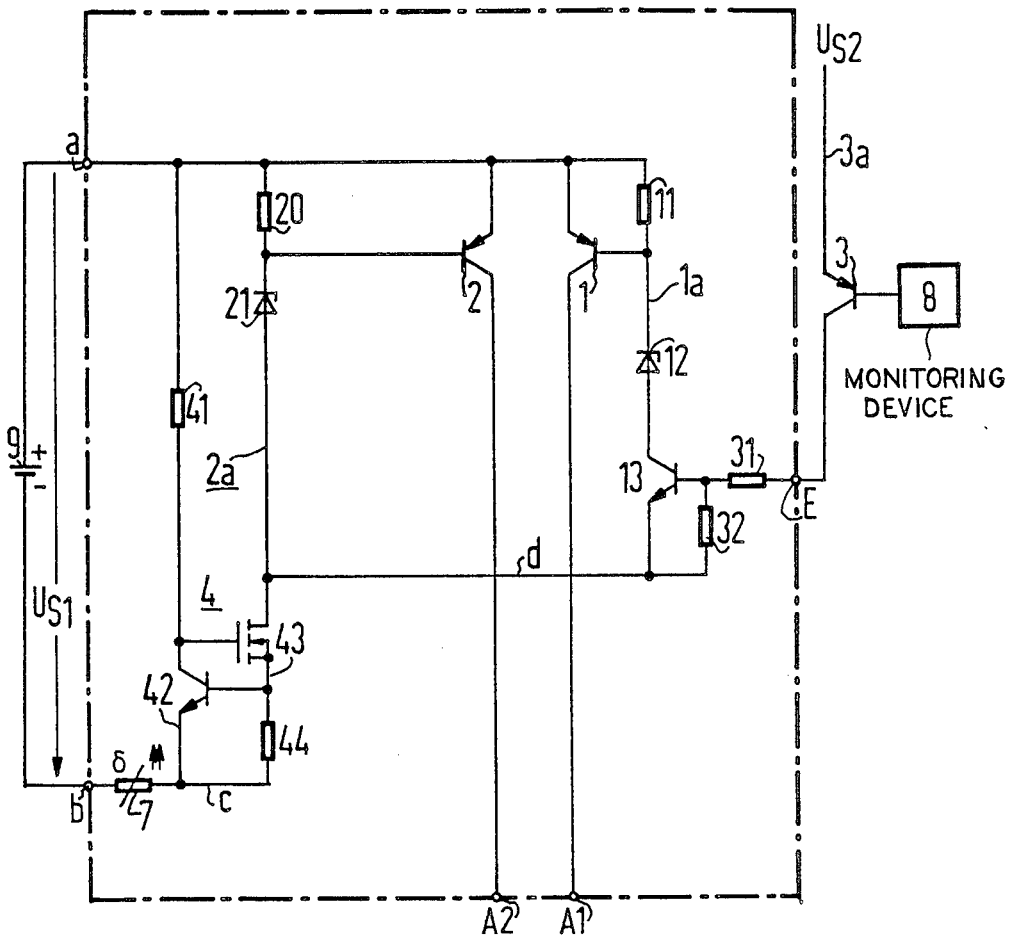
FIG. 1 is a signalling circuit for a broad range of operating voltages.

Given the signalling circuit shown in FIG. 1, the two transistors 2 and 1 serving as electronic switches respectively have their emitters directly connected to the ground terminal a. The collector of the transistor 1 is connected to the first output Al and the collector of the transistor 2 is conducted to the second output A2. The transistor 1 has its base connected to the first current path 1*a* and the base of the transistor 2 is connected to the second current path 2*a*.

The signalling circuit is fed with the supply voltage $U_{s1}$. The supply voltage source 9 has its positive pole at ground terminal a and has its negative pole at the supply voltage terminal b connected to the circuit point c via the PTC resistor 7.

A series circuit of the constant current circuit 4 and the two current paths 1*a* and 2*a* situated parallel to one another lies between the circuit point c and the ground terminal a, i.e. at the operating voltage $-U_{s1}$ reduced by the voltage drop at the PTC resistor 7.

The constant current circuit 4 is fashioned as a stabilizing circuit which contains the drain-source path of the MOS field effect transistor 43 as a controlled resistor. The drain electrode of the field effect transistor 43 is at the junction d of the current paths 1*a* and 2*a* . The source electrode of the field effect transistor 43 is connected to the circuit point c via the resistor 44. The NPN transistor 42 has its emitter at the circuit point c, has its base at the source electrode of the field effect transistor 43, and has its collector at the gate of the field effect transistor 43. The collector of the transistor 42 is also connected to the ground terminal a via the resistor 41.

The series connection of the source-drain path of the field effect transistor 43 and resistor 44 forms a bipolar circuit having an extremely large differential resistance, and acts as a constant current source for the two current paths 1*a* and 2*a* which are parallel to one another.

The first current path 1*a* contains the transistor 13 whose emitter is connected to the drain electrode of the field effect transistor 43. The resistor 32 is parallel to the base-emitter path of the transistor 13. The base of the transistor 13 is connected to the control input E of the circuit arrangement via the resistor 31. The collector of the transistor 13 is connected to the base of the transistor 1 via the Zener diode 12 polarized in a conducting direction. The resistor 11 is parallel to the base-emitter path of the transistor 1.

In the second current path, the drain electrode of the field effect transistor 43 is connected to the ground terminal a via the Zener diode 21 polarized in a conducting direction and via the resistor 20. The base of the transistor 2 is connected to the junction between the Zener diode 21 and resistor 20, so that the resistor 20 lies parallel to the base-emitter path of the transistor 2.

The input E of the signalling circuit is connected to the collector of the transistor 3 whose emitter is connected to the positive dc voltage $U_{S2}$. The base of the transistor 3 is connected to the monitoring device 8.

Given a conductive transistor 3, the control voltage $U_{s2}$ is at the input E as a first control criterion. Given an inhibited transistor 3, the high reverse dc resistance of the transistor 3 is effective at the input E of the circuit arrangement as a second control criterion.

The supply voltage of $U_{s1}=10 \ldots 75$ V is applied between the ground terminal a and the supply voltage terminal b. The signal defining the status of the signalling becomes effective at terminal point E. The output signals appear at the outputs A1 and A2.

In the normal condition, ground is connected through at the output A1. In the malfunction case, ground appears at the output A2 as a continuous signal. A pulsed signal whose corresponding output has not been shown in the drawing figure for reasons of clarity, is generated in the same way, but via a capacitive coupling.

As constant current circuit 4, the circuit arrangement employs an arrangement for current stabilization having the transistors 43, 42 and the resistors 44, 41. The voltage appearing at the resistor 44, which is proportional to the current through the transistor 43, is compared to the emitter-base voltage of the transistor 42. The relatively low-precision current stabilization achieved by means of this is entirely adequate for the present circuit arrangement.

The positive transmission switching voltage proceeds via the resistor 41 to the gate of the field effect transistor 43 which, in particular, is a power MOS field effect transistor. The employment of a field effect transistor is advantageous because a significantly greater value can be selected for the resistor 41 in comparison to a bipolar transistor. Given a preferred dimensioning of the current source, the current stabilized with the current stabilizing circuit averages 2 mA. Given the maximum voltage of 75 V, this means a power consumption of only 150 mW.

The monitoring device 8 serves, in particular, for monitoring supply voltages. When, in the normal condition, all output voltages of a current supply device are present in their proper size, the transistor 3 is switched conductive by the monitoring device 8, this transistor 3 connecting a positive potential of, for example, +5 V to the fault signal input E of the signalling circuit. The transistors 13 and 1 are switched conductive and the output A1 is connected to ground. The stabilized current of 2 mA flows in the first current path 1A and substantially provides base current for the transistor 1 via the Zener diode 12 and the emitter-collector path of the transistor 13.

No current can flow via the second current path 2*a* which is formed by the Zener diode 21 and the resistor 20 because, via the first current path 1*a*, the potential at the circuit point d is boosted to about −3.2 V, and thus lies clearly below the Zener voltage of the Zener diode 21. In this normal condition, the signalling circuit only consumes the stabilized current whose size is preferably selected in accordance with the load of the signal at the output A1 or at the output A2 and with the minimum transistor current gain of the transistor 1 or 2 and, in particular, amounts to 2 mA.

Given outage of an output voltage of the monitored current supply device, the monitoring device 8 inhibits the transistor 3. The transistor 13 is no longer driven, and likewise inhibits. Thus, its emitter potential becomes negative until the Zener voltage of the Zener diode 21 is reached. The stabilized current $I_s$ is, so to speak, switched over to the second current path 2*a* and now switches the transistor 2 conductive, so that the ground potential is connected through to the output A2.

The PTC resistor 7 is provided as a protective element instead of a fusible cut-out. Given a short or a faulty constant current circuit, it limits the current by means of a strong boost in resistance, so that further components or leads, particularly interconnects, cannot become jeopardized.

Figure 2:
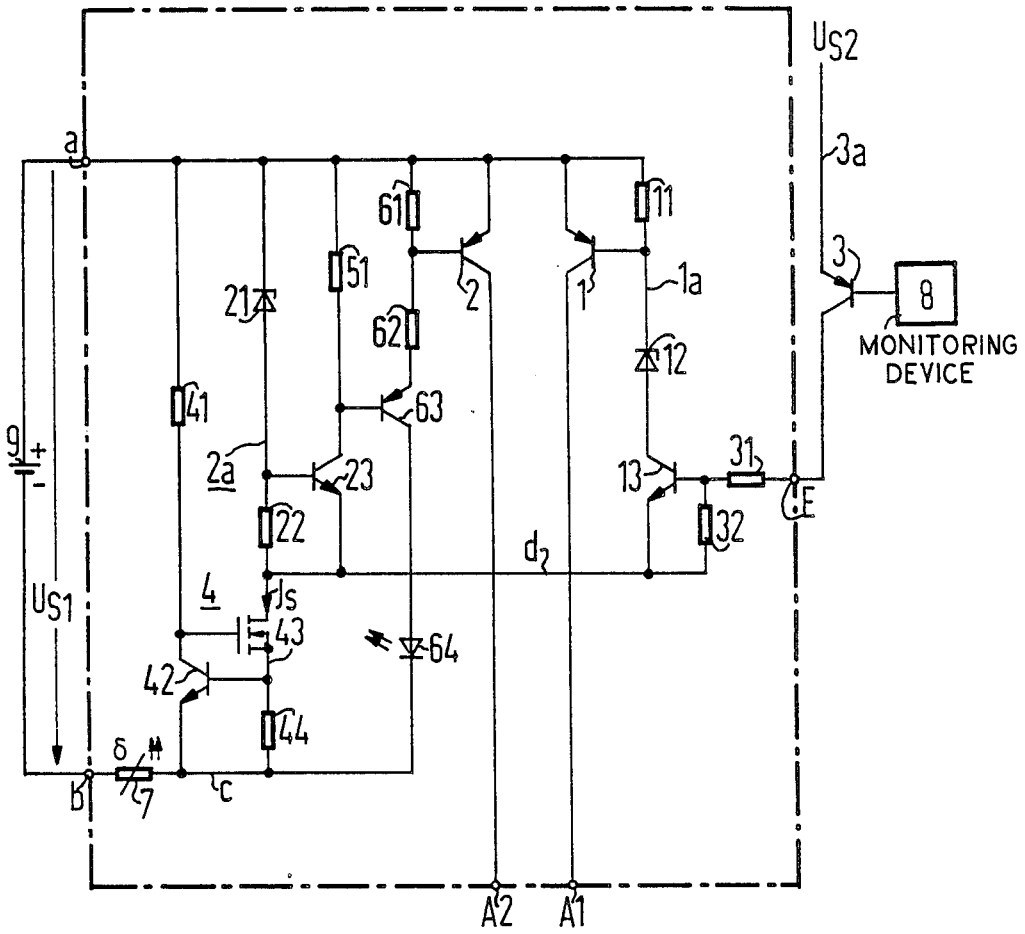
FIG. 2 is a signalling circuit having a display element for displaying fault status signals.

The signalling circuit shown in FIG. 2 largely coincides with that of FIG. 1. Departing therefrom, the transistor 2 does not have its base directly connected to the second current path 2*a*. On the contrary, the transistor 2 is indirectly controlled proceeding from the current path 2*a*. It is indirectly controlled via the two transistor stages comprising the transistors 23 and 63. The second current path 2*a* is formed of the Zener diode 21, the resistor 22, and the base-emitter path of the npn transistor 23.

The drain electrode of the field effect transistor 43 is connected to the ground terminal a via the emitter-base path of the transistor 23 and the Zener diode 21 polarized in a conducting direction. The resistor 22 is arranged parallel to the base-emitter path of the transistor 23. The collector 23 is directly connected to the base of the pnp transistor 63 and is connected to the ground terminal a via the resistor 51. The transistor 63 has its collector connected via the light-emitting diode 64 to the current point c and has its emitter conducted to the ground terminal a via the resistor 62 and the resistor 61 connected in series therewith. The base of the transistor 2 lies at the junction of the resistors 61 and 62.

No current can flow via the second current path 2*a* formed by the Zener diode 21 and the base-emitter path of the transistor 23 because, via the first current path 1*a*, the potential at the emitter of the transistor 23 is boosted to roughly −3.2 V, and thus lies clearly below the Zener voltage of the Zener diode 21. In this normal condition, the signalling circuit only consumes the stabilized current whose size is preferably selected in accordance with the load of the signal at the output A1 and the minimum transistor current gain of the transistor 1 or 2, and amounts in particular, to 2 mA.

When the stabilized current $I_s$ is switched to the second current path 2*a*, then it switches the transistor 23 conductive. As a consequence thereof, the transistor 63 is also driven. Together with the Zener diode 21 and the resistor 62, this transistor 63 forms a further current stabilizing circuit. The further current stabilizing circuit supplies a stabilized current of, in particular, 10 mA to the light-emitting diode 64 situated at the collector side of the transistor 64. This light-emitting diode 64 optically indicates device disruption. At the emitter side of the transistor 63, the transistor 2 is also switched conductive by this current flowing via the resistor 62, and the grounded potential is connected through to the output A2.

Given the afore-mentioned dimensioning example, the current consumption in the disruption case amounts to about 12 mA, regardless of the feed voltage. In this condition, the minimum operating voltage $U_{s1}$ derives from the Zener voltage of the Zener diode 21, from the emitter-base voltage of the transistor 23, and from an adequate operating voltage for the constant current circuit 4, amounting to a total of about 9 V. In the normal condition, only a constant current of 2 mA acquired by means of a first constant current circuit is taken from the operating voltage source 9, this current switching the transistor 1 for the signal in the normal operating condition conductive. In the malfunction case, the same current is switched over and used for the operation of a second constant current circuit with 10 mA for the light-emitting diode 64. What is achieved by a serial arrangement of the function parts is that this light-emitting diode current also simultaneously switches the transistor 23, 63, and 2 conductive. The power consumption of the overall signalling circuit therefore does not exceed 12 mA.

In a preferred embodiment of the signalling circuit, ground potential, loadable with 60 mA, is connected through in the normal condition at the output A1 rather than a negative feed voltage in the range ≦24 V. In the malfunction case, a ground potential for a continuous signal and for a pulsed signal each loadable with 12 mA is supplied at the output A2 rather than the aforementioned same feed voltage. The operating voltage $U_{s1}$ for the signalling circuit itself is independent of the feed voltage of the means for signal evaluation to be connected to the outputs A1 and A2, and can have a variety of nominal values between −12 and −60 V. The signalling circuit is therefore designed for an operating voltage range from −10 through −75 V.

Although various minor changes and modifications might be proposed by those skilled in the art, it will be understood that I wish to include within the claims of the patent warranted hereon all such changes and modifications as reasonably come within my contribution to the art.

I claim as my invention:

1. A signalling circuit, comprising:

an input;

means for supplying either a first input criterion or a second input criterion at said input;

a reference potenital;

first and second outputs;

circuit means given said first input criterion for providing at said first output substantially said reference potential and at said second output a high resistance, or given the second input criterion, said circuit means providing substantially the reference potential at said second output and a high resistance at the first input; and said circuit means comprising a first electronic switch connected between said first output and said reference potential, a second electronic switch connected between said second output and said reference potential, a constant current circuit connected between a first operating voltage source and a parallel connection of a first current path and a second current path commonly fed by the constant current circuit, means for connecting the first electronic switch to the first current path for control by current flowing in the first current path, means for connecting the second electronic switch to the second current path for control by current flowing in the second current path, and means connecting said input to said first and second current paths such that said first current path is conductive and said second current path is inhibited given said first input criterion and said second current path is conductive and said first current path is inhibited given said second input criterion.

2. A signalling circuit according to claim 1 wherein said means for supplying the first input criterion as a prescribable control potential and the second input criterion is an open input circuit, said first current path comprises a control path of a transistor having its control electrode connected to said input, the first and second current paths each having a non-linear means conductive above a prescribed voltage threshold and inhibited below said prescribed voltage threshold, and said voltage threshold of the non-linear means in the first current path being lower than the voltage threshold of the non-linear means in the second current path.

3. A signalling circuit according to claim 1 wherein a control path of at least one of said electronic switches is connected to one of said first and second current paths.

4. A signalling circuit according to claim 1 wherein a control path of at least one of said electronic switches is connected to its respective first or second current path via at least one transistor stage.

5. A signalling circuit according to claim 1 wherein said constant current circuit comprises a current stabilizing circuit in series to said parallel connection of the first and second current paths, said current stabilizing circuit being connected to said first operating voltage source, said current stabilizing circuit having a control path of a first transistor and a series connected resistor, a control path of a second transistor parallel to said resistor, and a collector of said second transistor being connected to a control terminal of said first transistor and also to the reference potential via a further resistor.

6. A signalling circuit according to claim 5 wherein said first transistor comprises a field effect transistor and said second transistor is a bipolar transistor.

7. A signalling circuit according to claim 1 wherein a further constant current circuit is connected to said second current path, said further constant current circuit having means connecting it for activation by a current flowing in said second current path; and a series connection of said further constant current circuit and a display element being connected to said first operating voltage source.

8. A signalling circuit according to claim 7 wherein said further constant current circuit comprises a transistor connected as a controlled resistance, said transistor being connected to a control stage, and said control stage connecting to a non-linear device in said second current path.

9. A signalling circuit according to claim 8 wherein said control stage comprises a transistor having its base emitter path in said second current path and its collector connected to a base of said transistor which is a controlled resistance, and wherein said transistor as a controlled resistance has its emitter-collector path connected to a control input of one of the electronic switches and also to the display element.

10. A signalling circuit according to claim 1 wherein said means for supplying said first or second input criterion includes a monitoring device.

11. A signalling circuit according to claim 10 wherein said monitoring device connects to a control input of a transistor which is either opened or closed by the monitoring device, said transistor being connected between a second voltage potential and the input.

12. A signalling circuit, comprising:

an input;

means for supplying either a first input criterion or a second input criterion at said input;

a reference potential;

first and second outputs;

circuit means connected to said input for providing, given said first input criterion, at said first output substantially a reference potential and at said second output a high resistance, or given the second input criterion, said circuit means providing substantially the reference potential at said second output and a high resistance at the first input; and said circuit means comprising a first electronic switch connected between said first output and said reference potential, a second electronic switch connected between said second output and said reference potential, a current supply circuit connected between a first operating voltage and a parallel connection of a first current path and a second current path commonly fed by the current supply circuit at one end and connecting to the reference potential at the other end;

means for connecting the first electronic switch to the first current path for control by current flowing in the first current path, and means for connecting the second electronic switch to the second current path for control by current flowing in the second current path.

* * * * *